US006250542B1

(12) United States Patent
Negelen

(10) Patent No.: US 6,250,542 B1
(45) Date of Patent: Jun. 26, 2001

(54) PAPERBOARD CARTON WITH END WALL HANDLES

(75) Inventor: Emanuel Negelen, Schweich (DE)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/555,249

(22) PCT Filed: Nov. 10, 1998

(86) PCT No.: PCT/GB98/03366

§ 371 Date: Jul. 11, 2000

§ 102(e) Date: Jul. 11, 2000

(87) PCT Pub. No.: WO99/28198

PCT Pub. Date: Jun. 10, 1999

(30) Foreign Application Priority Data

Nov. 28, 1997 (GB) ..... 9725242

(51) Int. Cl.[7] ..... B65D 5/46
(52) U.S. Cl. ..... 229/117.16; 206/427
(58) Field of Search ..... 229/117.09, 117.13, 229/117.16; 206/427

(56) References Cited

U.S. PATENT DOCUMENTS

| | | | | |
|---|---|---|---|---|
| 2,386,905 | | 10/1945 | Meitzen . | |
| 3,825,170 | * | 7/1974 | Aust et al. | 229/117.16 X |
| 3,881,648 | * | 5/1975 | Hall | 229/117.16 X |
| 4,029,207 | * | 6/1977 | Gordon | 206/427 |
| 4,101,052 | * | 7/1978 | Dove | 229/117.16 X |
| 4,105,152 | * | 8/1978 | Elward | 229/117.16 |
| 4,318,474 | * | 3/1982 | Hasegawa | 206/427 |
| 4,621,766 | | 11/1986 | McClure . | |
| 4,981,254 | * | 1/1991 | Depper | 229/117.16 X |
| 5,072,876 | | 12/1991 | Wilson . | |

FOREIGN PATENT DOCUMENTS

| | | |
|---|---|---|
| 88 14 572 | 2/1989 | (DE) . |
| 296 14 417 U 1 | 10/1996 | (DE) . |
| 0 434 401 A1 | 6/1991 | (EP) . |
| 2 456 039 | 12/1980 | (FR) . |

* cited by examiner

*Primary Examiner*—Allan N. Shoap
*Assistant Examiner*—Tri M. Mai

(57) ABSTRACT

According to the present invention, there is provided a paperboard carton having end wall handles. In further detail, the paperboard carton has a base panel, a top panel, two oppositely disposed side panels and two oppositely disposed end walls, each end wall comprising a portion of multiple thickness in which portion there is a handle opening.

10 Claims, 2 Drawing Sheets

PAPERBOARD CARTON WITH END WALL HANDLES

FIELD OF THE INVENTION

This invention relates to paperboard cartons with end wall handles.

SUMMARY OF THE INVENTION

According to the present invention, there is provided a paperboard carton having a base panel, a top panel, two oppositely disposed side panels and two oppositely disposed end walls, each end wall comprising a portion of multiple thickness in which portion there is a handle opening.

Preferably each end wall comprises an upper portion which is hingedly connected to the top panel and which comprises said multiple thickness portion, and a lower portion which is hingedly connected to the base panel, the upper portion being adhesively secured to the lower portion to fully enclose the ends of the carton. In a preferred arrangement the upper portion of each end wall comprises a first panel hingedly connected to the top panel, a second panel hingedly connected to the first panel and adhesively secured with respect to the first panel. Normally, the hinge connection between the first and second panels of each end wall is substantially parallel to the hinge connection between the first panel and the top panel.

In further embodiments each end wall further comprises a third panel. Conveniently said third panel is hingedly connected to said second panel, the hinge connection being substantially perpendicular to the hinge connection between the first and second panels. In one arrangement said third panel is hingedly secured between the first and second panels.

It is a preferred feature that a pair of side end panels is hingedly connected to respective side panels at each end of the carton, said side end panels being folded inwardly of the upper and lower end wall portions.

Preferably the top, one side panel, base and the other side panel are hingedly connected in series by means of substantially parallel fold lines and also an adhesive flap is hingedly connected to the top panel opposite said one side panel for attachment to the other side panel.

With preferred embodiments lines of weakening are provided in the top panel to facilitate access to the contents of the carton and conveniently said lines of weakening extend into the side panels.

BRIEF DESCRIPTION OF THE DRAWINGS

An embodiment of the present invention will now be described in more detail. The description makes reference to the accompanying drawings in which.

DETAILED DESCRIPTION

Figure 1:
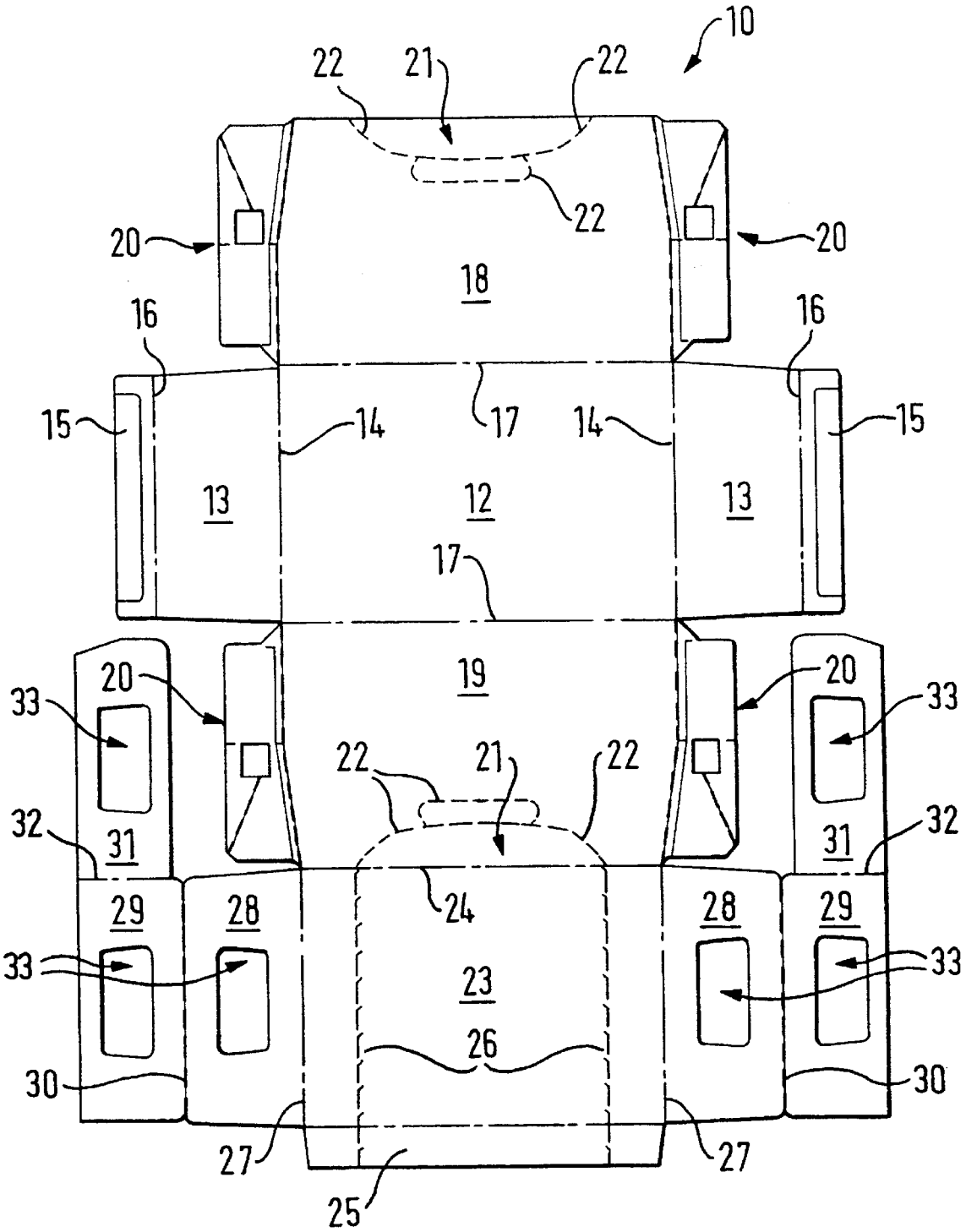
FIG. 1 shows a blank for producing a carton according to the present invention.
Figure 2:
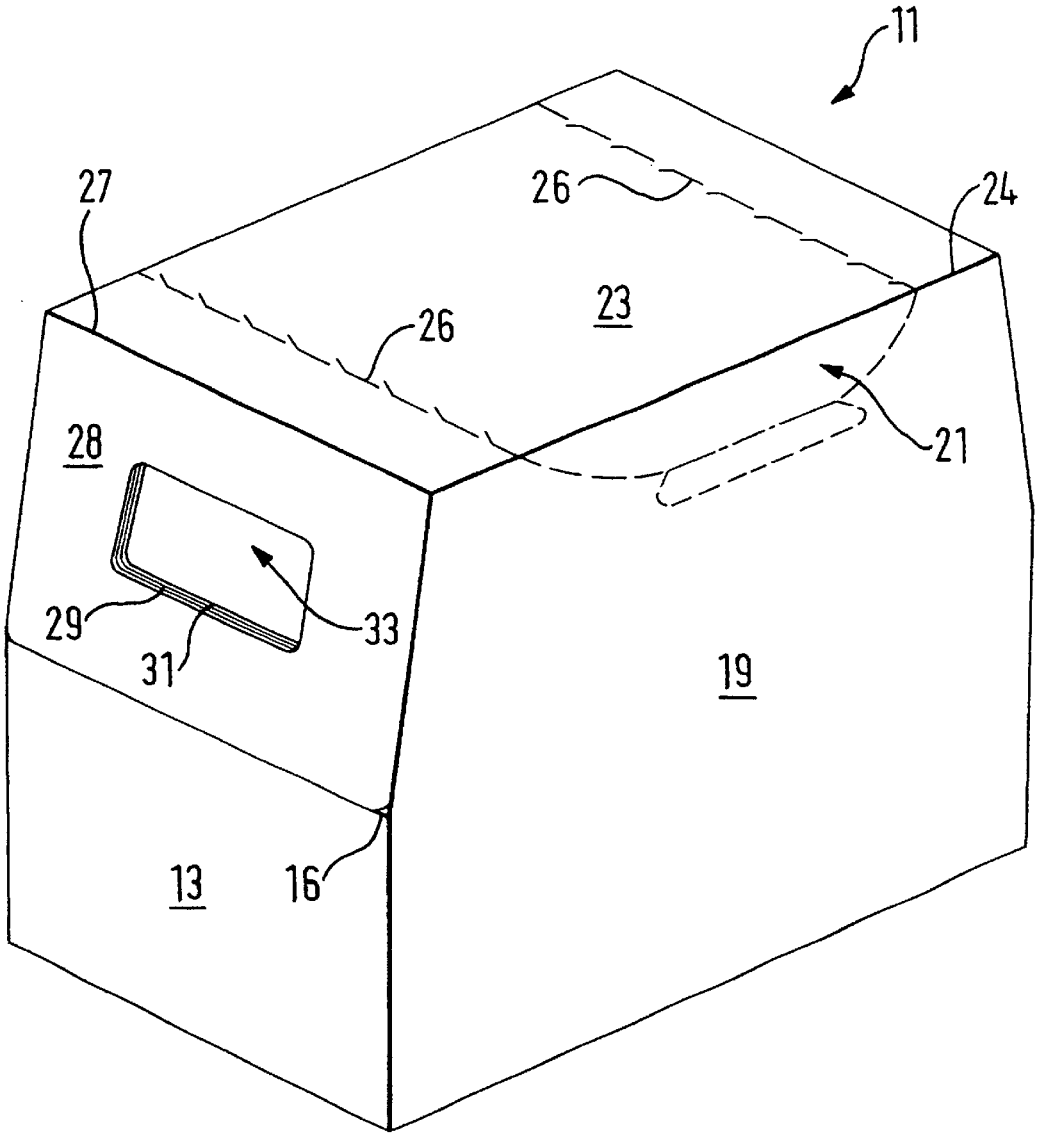
FIG. 2 is a perspective view of the assembled carton.

In the figures there is shown a paperboard blank 10 for producing a carton 11 containing a number of articles such as bottles or cans which are not shown. In the arrangement shown there would be a rectangular 6×4 array of bottles but any array of products could be accommodated with simple alterations to the dimensions and proportions of the blank 10.

The blank 10 has a rectangular base panel 12 having at each opposite lengthwise end a lower end wall 13 which is hingedly connected by a fold 14 to the base panel 12. Opposite the fold 14, each lower end wall 13 has an adhesive application area 15 and a parallel crease 16 slightly closer to the fold 14. When the carton is assembled, the crease 16 allows the blank to follow more closely the shape of the necks of the bottles contained in the carton.

At opposite side edges 17 of the base 12, first and second side panels 18, 19 are hingedly connected. Each side panel 18, 19 has a side end panel 20 hingedly connected at each end. The first side panel 18 terminates at its edge opposite the base 12 and has a small opening area 21 defined by lines of weakening 22.

The second side panel 19 also has a small opening area 21 defined by lines of weakening 22 but also has a top panel 23 hingedly connected to it along fold 24 which is substantially parallel to the side edges 17. Opposite the fold 24 is an adhesive panel 25 hingedly connected to the top panel. Substantially parallel lines of weakening 26 extend across the top panel 23 and the adhesive panel 25 from the ends of the lines of weakening 22 in the second side panel 19, at locations situated towards the lengthwise end edges 27 of the top panel.

At the end edges 27, first upper end wall panels 28 are hingedly connected to the top panel 23. Second upper end wall panels 29 are then hingedly connected by folds 30 which are parallel to end edges 27 and then third upper end wall panels 31 are hingedly connected by folds 32 which are perpendicular to the folds 30. Handle holes 33 are formed in each of the upper end wall panels 28, 29, 30.

Assembly of the carton 11 is simple and can be done around the articles or can be preformed as a sleeve with open ends prior to the insertion of the articles and closure of the end walls. Only one way of assembly will be described below, other ways of assembly being readily apparent to the skilled person.

The articles are placed on the base panel and the side panels 18, 19 are folded up with the side end panels 20 being folded inwardly so as to lie against the articles. The top panel 23 is folded over the tops of the articles and the adhesive panel 25, to which adhesive has already been applied is secured to the inside surface of the first side panel 18 between the articles and the first side panel 18.

The third upper end panels 31 are folded about folds 32 and adhered to the respective second upper end panels 29. These combinations of panels 29/31 are then folded about folds 30 and adhered to the respective first upper end panels 28. The lower end walls 13 are folded upwardly about the folds 14, adhesive is applied to areas 15 and the upper panel combinations 28, 29, 31 are folded down on to the respective adhesive areas 15 thereby securing and enclosing the ends of the carton 11.

The positioning of the holes 33 is such that the holes in each wall are aligned so that the carton can be carried in a similar manner as a crate. Also the lines of weakening 22, 26 in the top and side panels enables much of the top of the carton 11 to be removed which again is a feature normally associated with a crate. The multi-ply handle area combines strength with comfort.

It will be appreciated that more upper end wall panels could be hingedly connected depending on the required strength of the carton, or indeed one could be omitted thereby making the handle area double ply for smaller cartons. Also the configuration, size and precise shape of the panels as illustrated could be varied. However, the illustrated arrangement utilises space well so as to reduce wastage during manufacture of the blank 10. Also, although a generally rectangular type carton has been illustrated the invention could be applied to cartons of a variety of known shapes.

While preferred embodiments of the invention have been disclosed in the foregoing specification, it will be understood by those skilled in the art that variations and modifications can be made thereto without departing from the spirit and scope of the invention as set forth in the following claims.

What is claimed is:

1. A paperboard carton having a base panel, a top panel, two oppositely disposed side panels and two oppositely disposed end walls, each end wall comprising a portion of multiple thickness in which portion there is a handle opening, each end wall comprising an upper portion having a first panel hingedly connected to the top panel and a second panel hingedly connected to the first panel and adhesively secured with respect to the first panel thereby to constitute said multiple thickness portion, and a lower portion which is hingedly connected to the base panel, the upper portion being adhesively secured to the lower portion to fully enclose the ends of the carton.

2. A paperboard carton as claimed in claim 1, wherein the carton is formed from a paperboard blank.

3. A paperboard carton as claimed in claim 1 wherein each end wall further comprises a third panel.

4. A paperboard carton as claimed in claim 3 wherein said third panel is hingedly connected to said second panel, the hinge connection being substantially perpendicular to the hinge connection between the first and second panels.

5. A paperboard carton as claimed in claim 4 wherein said third panel is adhesively secured between the first and second panels.

6. A paperboard carton as claimed in claim 1 wherein the hinge connection between the first and second panels of each end wall is substantially parallel to the hinge connection between the first panel and the top panel.

7. A paperboard carton as claimed in claim 6 wherein a pair of side end panels is hingedly connected to respective side panels at each end of the carton, said side end panels being folded inwardly of the upper and lower end wall portions.

8. A paperboard carton as claimed in claim 7 wherein the top, one side panel, base and the other side panel are hingedly connected in series by means of substantially parallel fold lines and also an adhesive flap is hingedly connected to the top panel opposite said one side panel for attachment to the other side panel.

9. A paperboard carton as claimed in claim 1 wherein lines of weakening are provided in the top panel to facilitate access to the contents of the carton.

10. A paperboard carton as claimed in claim 9 wherein said lines of weakening extend into the side panels.

* * * * *